US007070497B2

(12) United States Patent
Mhatre

(10) Patent No.: US 7,070,497 B2
(45) Date of Patent: Jul. 4, 2006

(54) DIFFUSER FOR CENTRAL AIR CONDITIONING SYSTEM

(76) Inventor: Ramesh Nana Mhatre, B-701 Centre Point, Panch Pakhadi, Thane, Maharashtra (IN) 400 602

( * ) Notice: Subject to any disclaimer, the term of this patent is extended or adjusted under 35 U.S.C. 154(b) by 0 days.

(21) Appl. No.: 10/650,735

(22) Filed: Aug. 29, 2003

(65) Prior Publication Data

US 2005/0260945 A1 Nov. 24, 2005

Related U.S. Application Data

(63) Continuation-in-part of application No. PCT/IN02/00033, filed on Feb. 28, 2002.

(30) Foreign Application Priority Data

Mar. 2, 2001 (IN) ..... 219/01

(51) Int. Cl.
*F24F 13/08* (2006.01)

(52) U.S. Cl. ..... 454/300; 454/310

(58) Field of Classification Search ..... 454/300, 454/310, 311, 312
See application file for complete search history.

(56) References Cited

U.S. PATENT DOCUMENTS 2,531,733 A * 11/1950 Honerkamp ..... 454/310
2,928,331 A * 3/1960 Averill ..... 454/300
4,714,009 A * 12/1987 DeHart et al. ..... 454/300
5,658,196 A 8/1997 Swaim

FOREIGN PATENT DOCUMENTS

WO 98/33022 7/1998

OTHER PUBLICATIONS

*Flexiflo Engineering Manual #34*, 1957, Universal Diffuser Corp., Tuckahoe, NY, pp. 4B-4D, 53 and 60.*
*Flexiflo Engineering Manual #34*, 1957, Universal Diffuser Corp., Tuckahoe, NY, pp. 4B-4D, 41,53 and 60.*
*Flexiflo Engineering Manual #34*, Universal Diffuser Corp., Tuckahoe, NY, 1957, entire document.*
*Patent Abstracts of Japan*, 11 132543, May 1999, Japan.

* cited by examiner

*Primary Examiner*—Gregory Wilson
(74) *Attorney, Agent, or Firm*—Bacon & Thomas PLLC

(57) ABSTRACT

Diffuser for central air conditioning system includes a single continuous piece center core for cooperating with an intermediate core and an outer frame, the center core including an outwardly and downwardly directed slanting surface generally originating from a center apex and terminating at an edge at its bottom periphery. A pair of opposed vertical strips are attached at the back upper side of the slanting surface in spaced apart relationship and opposing each other, and opposing holes or openings are provided in each vertical strips. An intermediate core made in a single continuous piece is disclosed and includes a vertical collar at its top, and an outwardly and downwardly directed slanting surface at a terminal edge area. An outer frame element made in a single piece includes an upper collar with holes and a downward slanting wall terminating at a flange. A rod/pipe connector extending through the holes retains the assembly together in nested relationship.

8 Claims, 13 Drawing Sheets

DIFFUSER FOR CENTRAL AIR CONDITIONING SYSTEM

This application is a continuation-in-part of International Patent Application No. PCT/IN02/00033 filed Feb. 28, 2002, published in the English language and designating the United States.

BACKGROUND OF THE INVENTION

A. Field of the Invention

This invention relates to the new diffuser for central air conditioning system and the incorporated parts of diffuser namely flower or centre core, core assembly, outer frame, etc. and the method of manufacturing the same.

B. Related Art

In a central air conditioning system, the air is conditioned to a desired temperature at one source is distributed at various places through network of ducts and diffuser is required at every outlet of the duct.

Generally these ducts are of square or rectangular cross section, most probably due to their easy self-resting and properly adjusting nature in corners of the ceiling in the buildings and vehicles, and therefore the diffuser used at the outlet of an distribution duct is also of square or rectangular in shape.

The diffuser fitted at the end of the air distribution duct projects/exposes out from the ceiling of a room or any other space required to be air conditioned and therefore it plays a part in interior decoration or all over look of the room/space.

The diffuser mainly consists of an outer frame having a square/rectangular collar, according to the cross-section of the duct, an outwardly slanting surface at all the four sides projecting downward from the said collars and then a substantially horizontal flange, the outer free edge of which is bent upward, a centre core for blocking/preventing the air stream coming through the duct from escaping out centrally with a force and diffusing it in all sides and one or more intermediate cores provided in between the centre core and each of the intermediate cores are having a square/rectangular collar, an outwardly slanting surface at all the four sides projecting downward from the said collar and then ending into a substantially horizontal flange.

The centre core and the intermediate core (s) are assembled together in a spaced-apart manner, keeping the slanting surfaces parallel to each other with the help of at least a pair of rods/pipes passing through the collars and attached to the collar of the outer frame in a easily detachable manner, and kept in position with the help of biased springs. The outer frame in turn is attached to the outlet of air distribution duct.

The diffusers are manufactured in various sizes to be used according to the size or volume of room or space to be air conditioned. Generally the size of centre core is same in all the diffusers but the number of intermediate cores varies according to the size of the outer frame.

The cores and the outer frame of the existing diffusers are made of four side sections, which are assembled together by using four corner sections. Each side section consists of a vertical portion at top, a downwardly slanting portion in middle and a horizontal flange at the bottom. The slanting portion of each core section and horizontal flange of outer frame is provided with a grooved channel section on its back surface to accommodate the corner sections on assembly. The horizontal flange of each side sections of the outer frame may also be bend upwardly and outwardly at the outer periphery.

The existing diffusers suffer from the following drawbacks:

1. When the diffuser is attached to the duct and the conditioned air is blown through the duct it is noticed that the air is not diffused equally on all sides as the corner sections and the grooved channel sections and ridges at the back surfaces of the cores come in the path of air and disturbs the equal and proper diffusion of air in the path of air and disturbs the equal and proper diffusion of air in all directions. The enclosed collars of the centre core and intermediate core(s) rebounds the air and thereby reducing the flow of air through corners of the diffuser.
2. As the diffuser is manufactured in several pieces and then the various pieces are assembled, thus manufacturing process is cumbersome, time consuming and labour oriented which increases the cost of production.
3. On assembly some times there remains a gap between two side sections, at the corners of the core(s), due to which diffusers are rejected resulting into a big loss of production i.e. material and labour and which increases the cost of production.
4. To avoid gaps at the corner of the core(s) the side sections of the cores are produced with high precision and which increases the cost.
5. Due to the grooved channel sections at the backside section and corner sections used for the assembly of cores the weight of the diffuser is increased which also increases the cost of production.
6. Some time the side sections of each core and outer frame are welded together at corners, to avoid gaps, or corner sections after fixing into the crimped for 3 assembly. The cores are interconnected through connecting strips, welded to the collars of each core. The welding and crimping operations require extra equipment as well as these operations are very time consuming thereby increasing the cost of production.
7. Due to the grooved channel sections and corner sections or ridges and welding spots on the back surface of the core(s) the dust is accumulated therein, which is difficult to clean.
8. The dust is also accumulated in the gaps at the corners on the front surface of the cores, which gives a dirty look to the diffuser and tarnish the interior decoration/look of the room/space.

BRIEF SUMMARY OF THE INVENTION

The main object of this invention is to obviate the above mentioned Drawbacks of the existing diffusers and to provide a new diffuser for central air conditioning system wherein each of the central core and/or the intermediate core(s) and/or the outer frame are manufactured in a single piece and both the outer as well as inner surfaces of the cores and/or the outer frame are smooth without any extra section, projection or groove which dispenses with the requirement of extra material.

And the time taken for assembly is also very much reduced and at the same time there is no obstacle in the flow path of air which is diffused equally in all the directions. As the cores are manufactured in a single piece there is no question of any gap at the corners thus no chance of rejection of the product and no need of any welding or joining or crimping operation and hence the cost of production of the diffuser will be obviously very less.

Another object of this invention is to provide a new diffuser wherein the enclosed corners of the dollars at the back side of the cores are removed to avoid air flow from all the corners of the diffuser, thus the air distribution is proper and equal in all the direction. A further object of this invention is to provide a new diffuser wherein dust accumulation on front as well as back surface of the cores and outer frame is minimized due to both surfaces being smooth. There in no problem in dust cleaning and as there is no gap at corners, no dust accumulation and hence the diffuser which may be coated in any desired colour appears always clean and nice.

A further object of this invention is to provide a Diffuser, which is light in weight and easy to manufacture and easy to store and transport.

According to a further object of this invention, the centre core, intermediate core(s) and outer frame, each of which are of single piece construction, can be manufactured, stored and transported separately and easily assembled ever when required to form a new diffuser or can be used as a separate part/spare part for replacement in an existing diffuser. Thus according to this invention, a single piece centre core, at least one intermediate core and an outer frame, for the new diffuser for use in central air conditioning system, said centre core comprises of an outwardly and downwardly directed slanting surface originated from a centre point/apex and ending into a peripheral flange at its bottom and being made in a single piece having its inner and outer surfaces smooth, a plurality of spaced apart vertical strips having a pair of holes or openings on the opposing vertical sides, At least one or more plurality of said one piece intermediate core for said diffuser comprises of a vertical collar at the top, an outwardly and downwardly directed slanting surface and a peripheral flange at its bottom and being made in a single piece having its inner and outer surfaces smooth, a plurality of opposite vertical sides of the collar being provided with at lease a pair of opposing holes or openings;

A single piece outer frame, for the said diffuser comprises a stepped vertical collar at the top, an outwardly and downwardly directed slanting surface and a peripheral flange at its bottom, the outer free edges of the said flange preferably being bent upwards and being made in a single piece having its inner and outer surface smooth, the two opposing sides of the said vertical collar being provided with at least a pair of opposite holes or openings;

Said centre core, intermediate core (s) and the outer frame forming constituent parts of said new diffuser.

According to further feature of this invention, the method of manufacturing said new diffuser having said centre core, intermediate core (s) and outer frame comprises of the following steps:

a) making the said centre core in single piece with the help of suitable dies in a sheet metal press, carrying the operations of cutting and bending, having its inner and outer surfaces smooth;

b) making the said intermediate core(s) in single piece, with the help of suitable dies, in a sheet metal press, carrying the operations of cutting, bending and piercing having its inner and outer surface smooth;

c) making the said outer frame in single piece, with the help of suitable dies, in a sheet metal press, carrying the operations of cutting, drawing, bending and piercing having its inner and outer surface smooth;

d) attaching the said Centre Core with the said intermediate core(s) keeping their slanting surfaces parallel to each other by passing at least a pair of rods/pipes or sections of the shape of the hole or opening, through the holes or openings provided in the said vertical strips integrally provided on the vertical face at the backside of the said centre core and through the holes or openings in the vertical collars of the said intermediate core(s);

e) attaching the assembly of above step (d) to the outer frame with the help of the said rods/pipes/sections of shape of hole, the free ends of which passing through the holes or openings provided in the opposing sides of the vertical collar of the said outer frame, one end of the said pair of rod/pipes being kept spring biased for easily detaching the assembly of said cores from the outer frame;

f) painting, plating or powder coating the said centre core, intermediate core(s) and the said outer frame separately or in assembly.

DESCRIPTION OF THE DRAWINGS

The invention will be clear from the following description when described with reference to accompanying drawing wherein.

DETAILED DESCRIPTION OF PREFERRED EMBODIMENTS OF THE INVENTION

Figure 1:
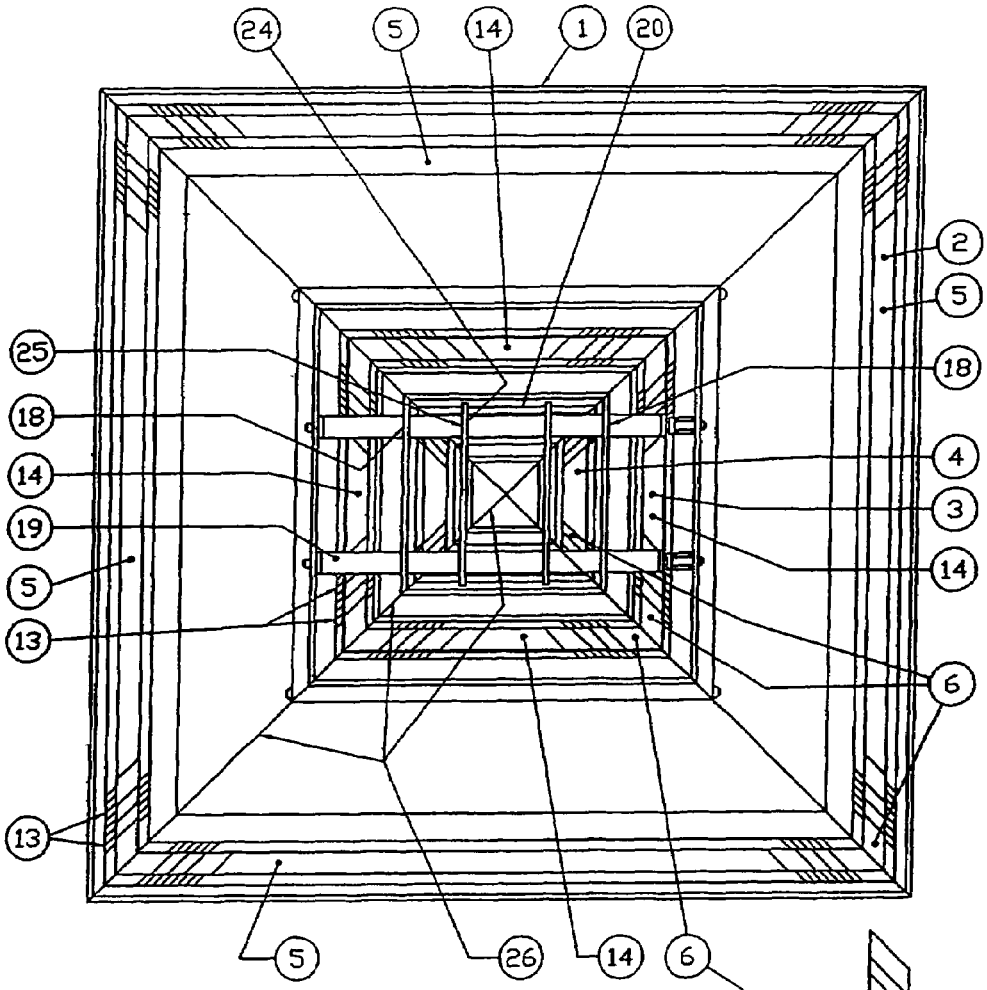
FIG. 1 Prior Art
FIG. 1 Shows in plan, the existing diffuser assembly
Figure 3:
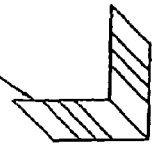
FIG. 3 Prior Art
FIG. 3 Shows in plan a corner piece used in assembling the various pieces (said sections) of cores and/or outer frame of the existing diffuser FIGS. 4 & 5 Shows the plan and elevation respectively, of an embodiment of the new diffuser assembly, according to an embodiment of this invention FIGS. 6, 7 & 8 Show the plan, elevation and end view respectively, of the single piece center core of the new diffuser, according to an embodiment of this invention.
Figure 2:
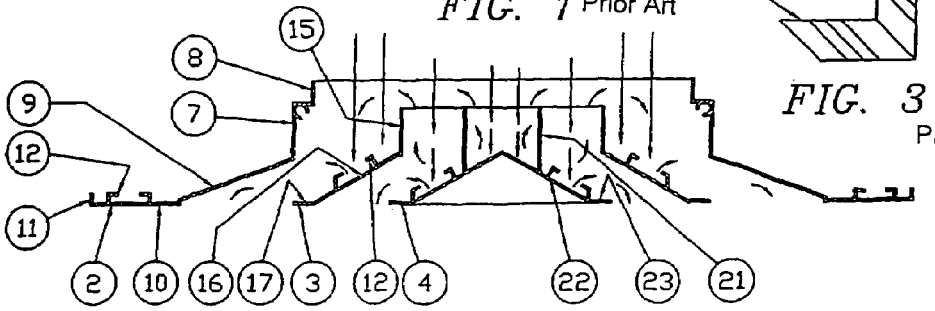
FIG. 2 Prior Art
FIG. 2 Shows the sectional elevation of FIG. 1 along with the direction of air flow and change due to obstacles in the flow.
Figure 5:
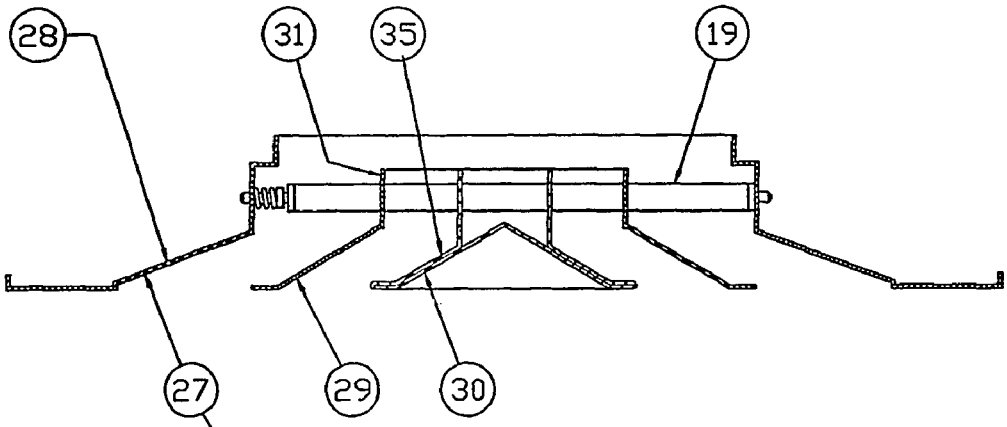
Figure 4:
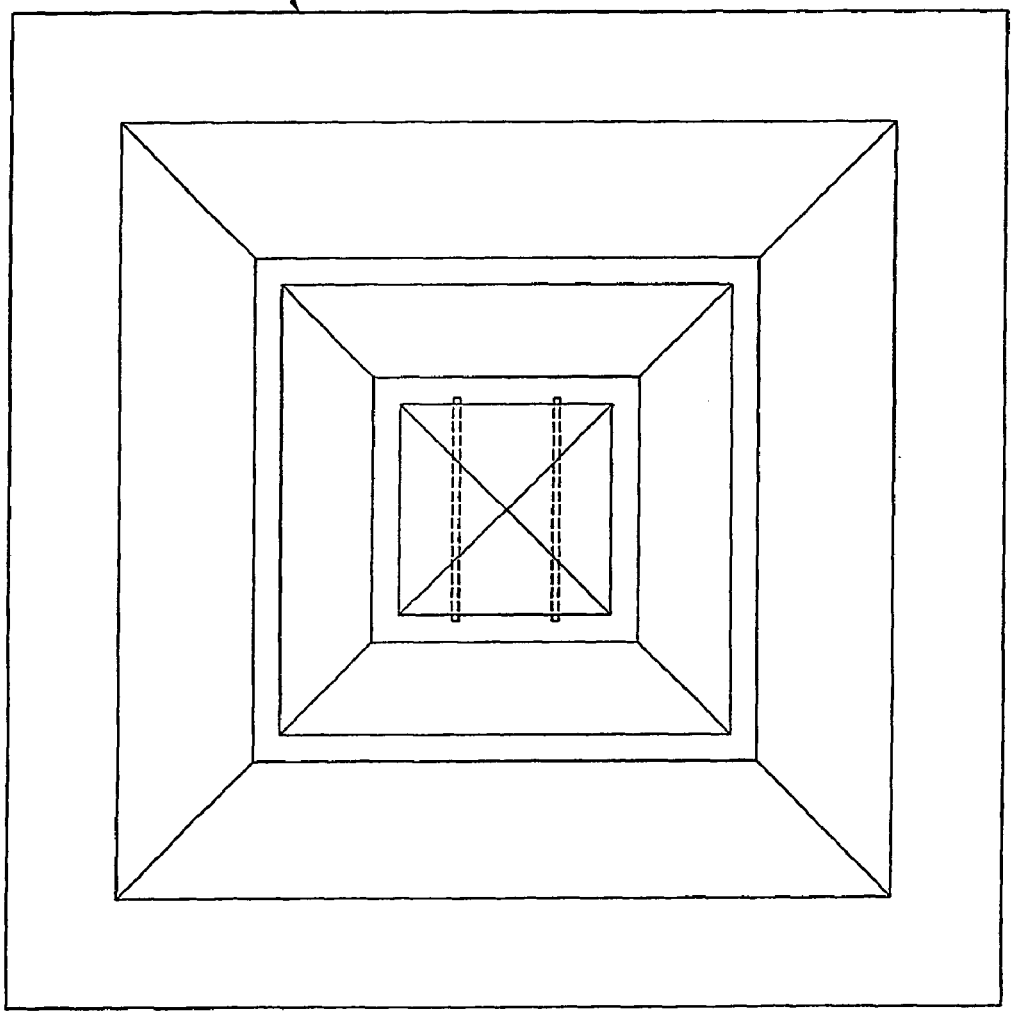
Figure 6:
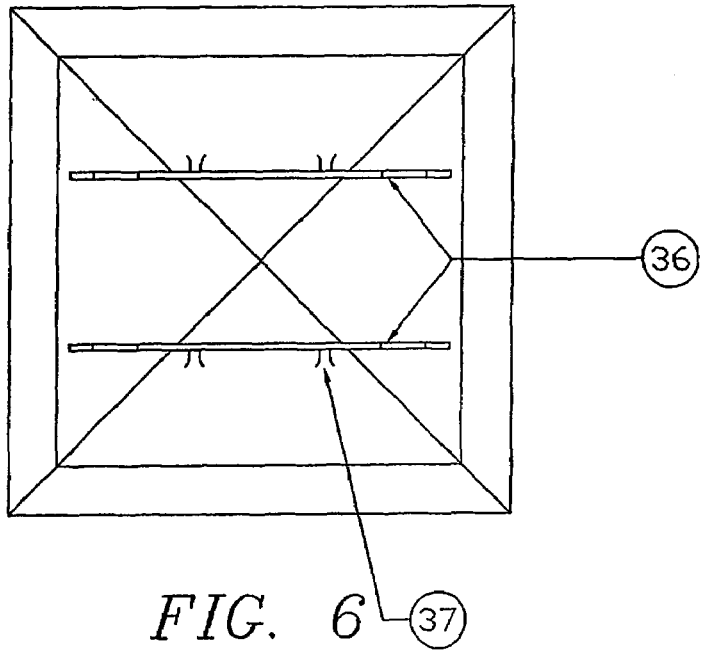
Figure 7:
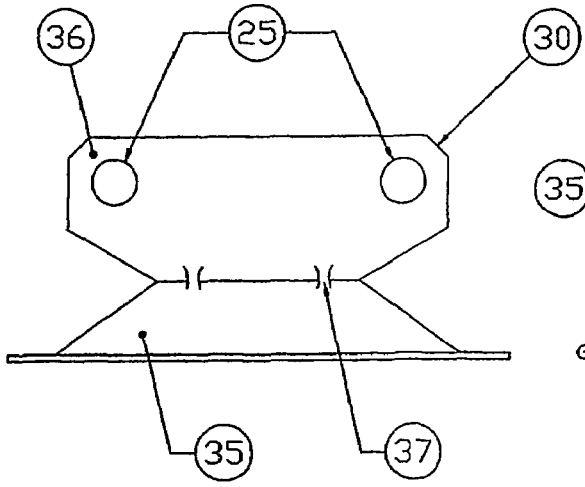
Figure 8:
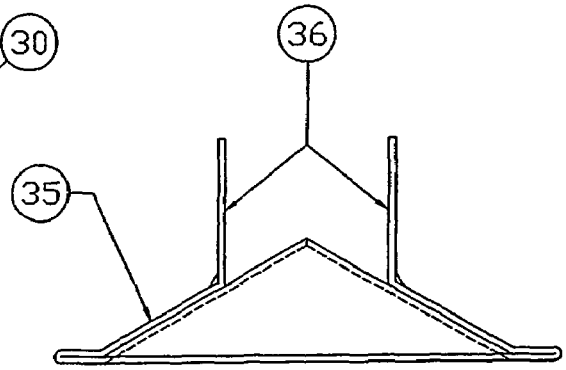

Referring to FIGS. 1 to 3, the existing diffuser (1) comprises an outer frame (2), one or intermediate core (s) (3) and a centre core (4). The outer flame (2) is made by assembling four side sections (5) with the help of four corner sections (6) consists of a vertical side (7) which is bent to form an angle (8) at top, and an outwardly slanting surface (9) at bottom and then a substantially horizontal flange (10) the outer free edge of which is bent upward as shown at (11) to give strength. A grooved channel (12) is formed at the upper/back surface of the flange (10) to accommodate corner section (6) on assembly. The four such side sections (5) are assembled together with the help of corner sections (6) and crimped as shown at (13), to hold the various pieces together. The upper vertical sides on assembly from a square or rectangular collar at the top of the outer frame, according to the size of the duct to which the diffuser is to be attached.

The intermediate core(s) (3) is/are also made of four side sections (14) which are assembled together with the help of four corner sections (6). Each side section (14) consists of a vertical side (15), an outwardly and outwardly slanting surface (16) and a substantially horizontal flange (17). The slanting surface (16) is provided with grooved channel (12) at its top/back surface for accommodating a corner section (6) on assembly. Four such side sections (14) are assembled together with the help of four corner sections (6) which are crimped together as shown by numeral (13) to hold the various pieces together. The upper vertical sides (15) of the said sections (14) form an enclosed square or rectangular collar at the top of intermediate core (3). A pair of holes or openings (18) are provided in two opposite vertical sides (15) for passing there through a pair of rods pipes (19) for holding the centre core (4), intermediate core(s) (3) and outer frame (2) together.

The centre core (4) is also made of four side sections (20) which are assembled together with the help of four corner sections (6). Each side sections (20) consists of a vertical side (21), an outwardly and downwardly slanting surface (22) extending up to the central point and a substantial flange (23). The slanting surface for accommodating corner sections (6) on assembly, contains grooved channels on the back side. Four such side sections (20) are assembled together with the help of four corner sections (6) which are crimped together to the centre core (4), having an enclosed collar at the top. Two plates (24) are riveted to the two opposite vertical sides (21) through which two pairs of opposing holes or openings (25) are provided for passing there through the pair of rods/pipes (19) to hold the centre core (4) with the intermediate core(s) (3) and outer frame (2).

Generally after assembly of various sections, gaps (26) are noticed at the corner of intermediates core(s) (3) and centre core (4) which result into rejection of the product/diffuser.

Further the grooved channels (12) and the corner sections (6) on the back surface of the cores rebounds the air flow and disturbs the equal and proper diffusion of air in all directions. The enclosed collars formed by the vertical sides of the side sections of each core on assembly, rebounds the air flow, as shown by arrows in FIG. 2, which reduces the air flow from the corners and thus the diffusion of air is not proper and equal in all the directions, by the existing diffusers.

Besides these deficiencies in the functioning of the existing diffusers, they require more material, labour and time, ultimately resulting into higher cost of the product as well as they are not pleasant in looks, accumulate dust and are difficult to clean specially from the back surface of the cores.

Referring to FIGS. 4 to 15 the new diffuser (27) according to an embodiment of this invention comprises an outer frame (28), one or more intermediate core(s) (29) and a single piece centre core (30). In the embodiment illustrated, the diffuser (27), and each of the outer frame (28), intermediate core(s) (29), and centre core (30), are square in perimeter, having four corners. The construction of outer frame (20) is similar to the outer frame (2) of the existing diffuser except that the outer frame (28) is preferably made in a single piece there by saving the time and labour used for the assembly of various pieces/sections of outer frame (2) of existing diffuser (1) and at the same time grooved channels (12) and corner sections (6) are not required which results into saving in the material also.

Figure 9:
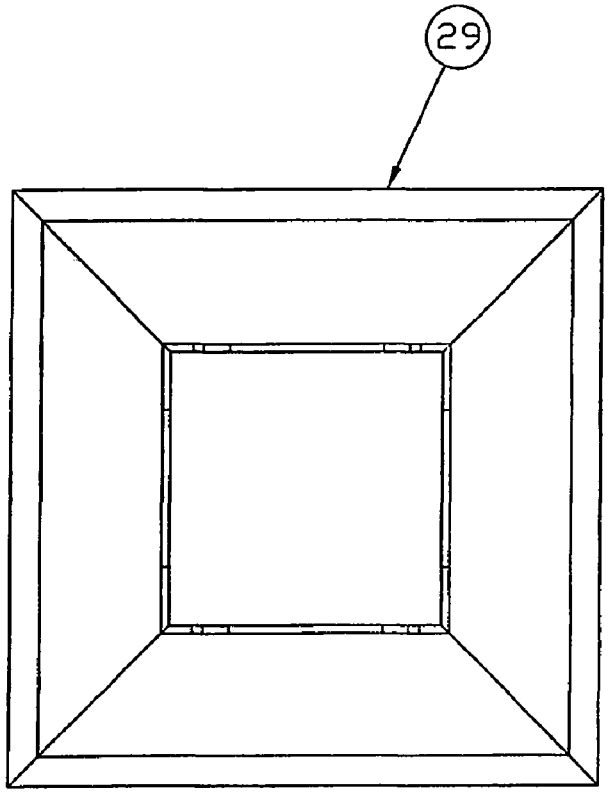
FIGS. 9, 10 & 11 Show the plan, elevation and end view, respectively of the single piece intermediate core(s) of the new diffuser, according to an embodiment of this invention FIGS. 12 & 13 Show the plan elevation respectively of the single piece outer frame of the new diffuser, according to an embodiment of this invention the existing diffuser assembly FIG. 14 Shows in part perspective view, the new diffuser assembly, according to this invention FIG. 15 Shows in part sectional elevation the diffuser assembly showing the air flow through the New diffuser according to this invention.
Figure 11:
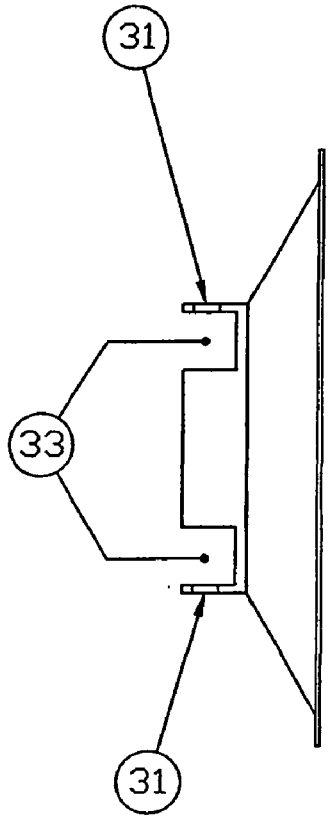
Figure 10:
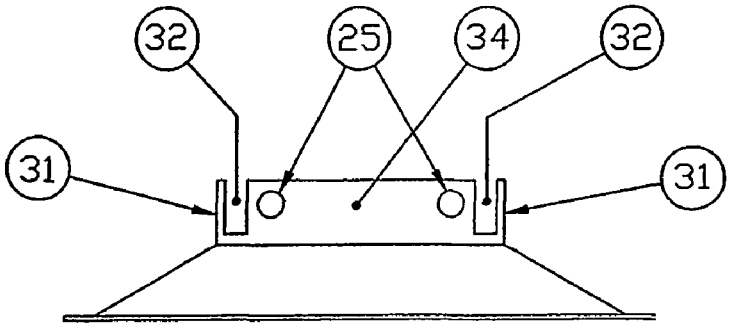
Figure 13:
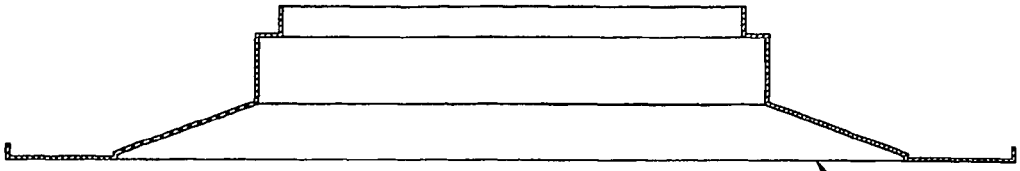
Figure 12:
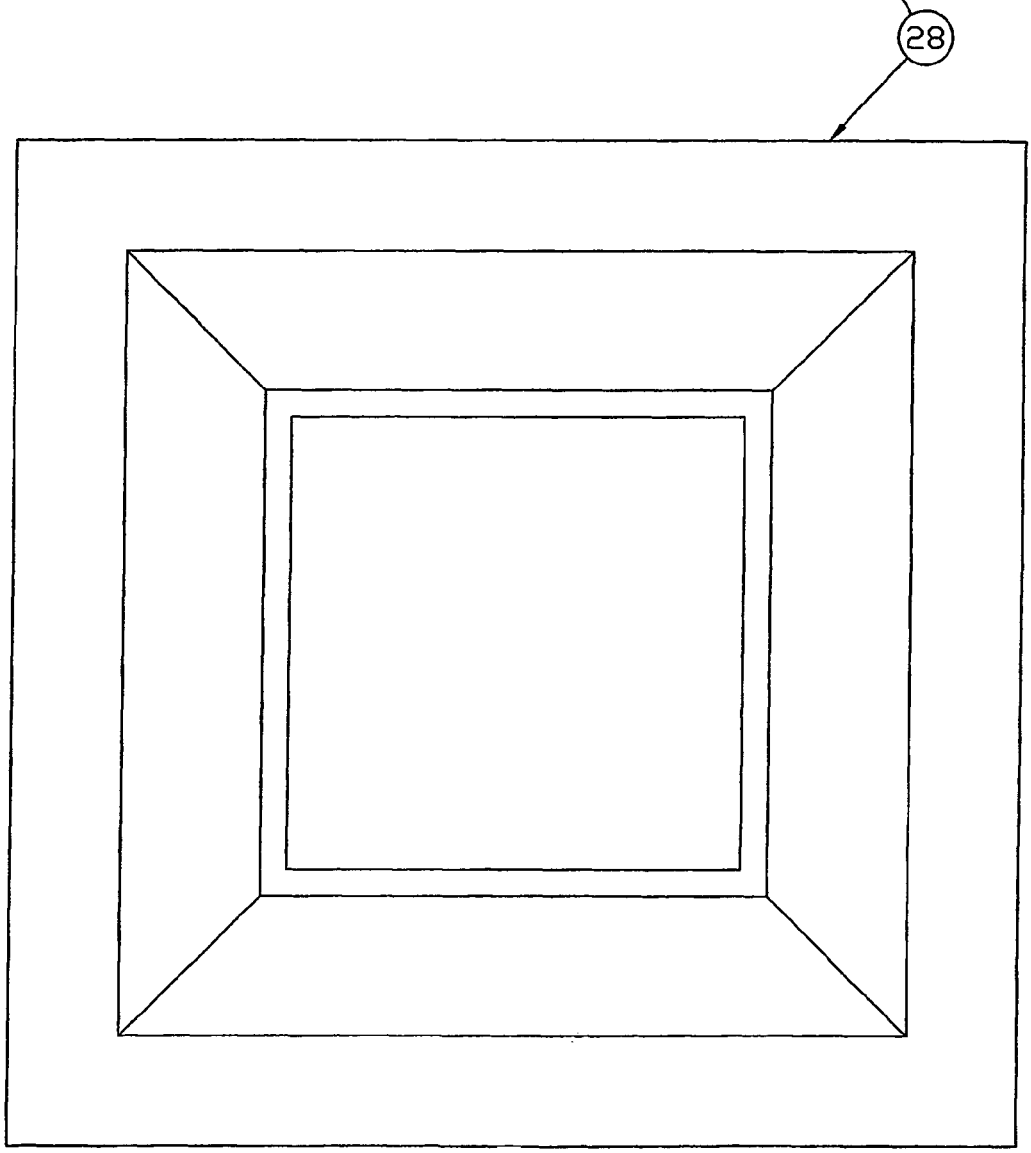
Figure 14:
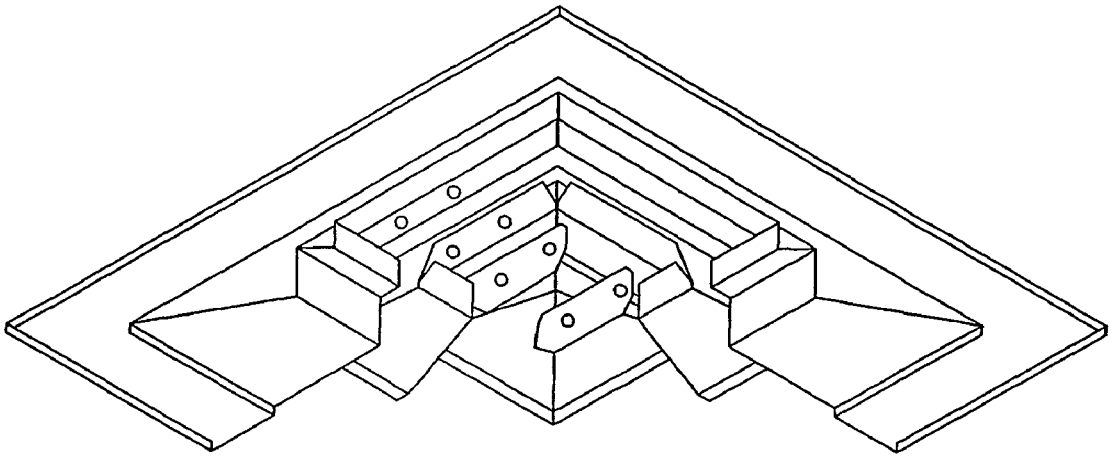
Figure 15:
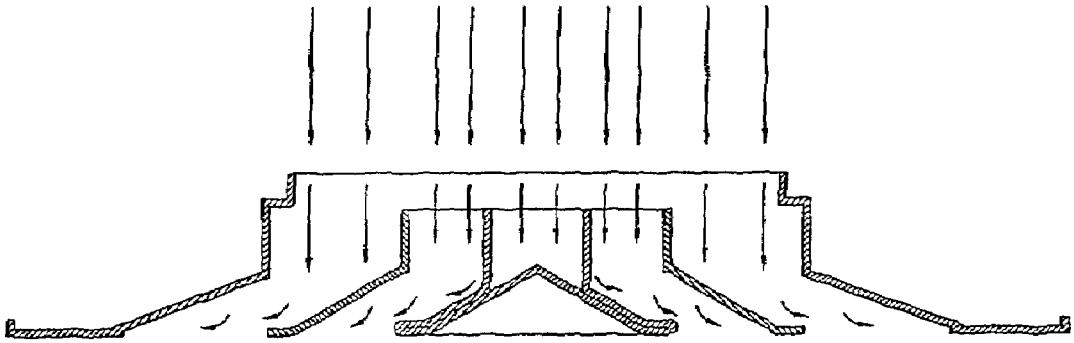
Figure 16:
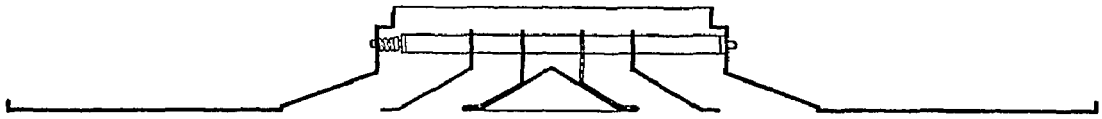
FIGS. 16, 17, 18, 19, & 20 Shows the different models of diffusers by increasing the flat flange of outerframe and keeping the outer size as standard.
Figure 17:
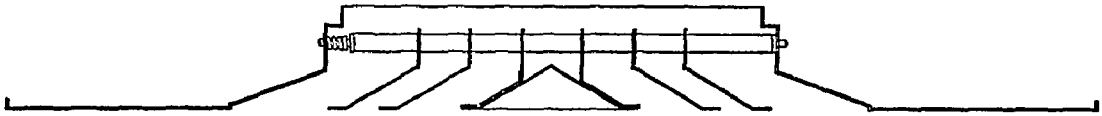
Figure 18:
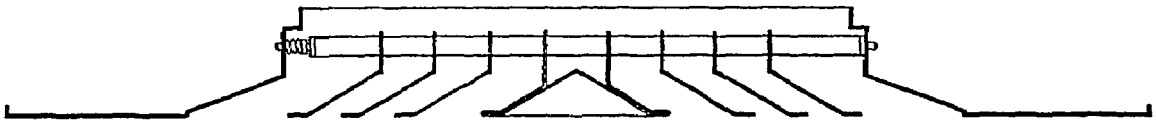
Figure 19:
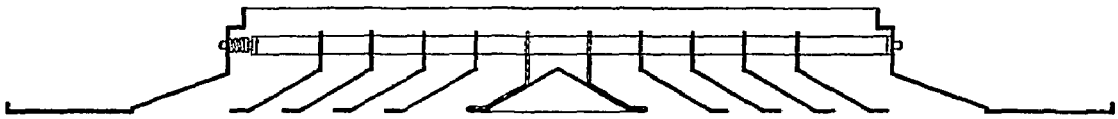
Figure 20:
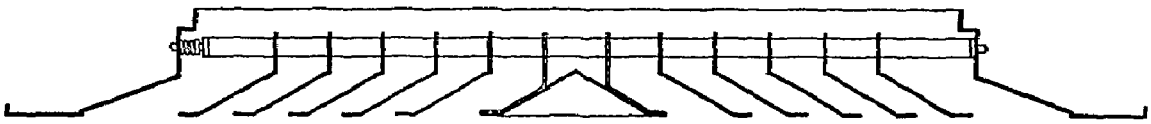

The intermediate core(s) (29) of the new diffuser (27) is/are preferably made in a single piece and thus the grooved channels (12) are not provided on the slanting surface. Further corner sections (6) are also not required. According to this invention the vertical collar (31) of the intermediate collar(s) (29) is not an enclosed collar i.e. the four corners of the vertical collar (31) are not provided i.e. there are formed clear slots (32 & 33) at the four corners, as shown in FIGS. 9, 10 & 11. The two opposing vertical sides (34) are provided with two pairs of opposing holes (25) for passing there through a pair of rods (19) for attaching the intermediate core(s) there is no assembling operation for individual core or flower or outerframe, hence saving in material, labour & time. Further as the enclosed collar is avoided i.e. the four corners of the vertical collar are provided with slots (32 & 33), there is no rebounding of air due to grooved channels and corner sections on the back side of slanting surfaces of the cores which are clear and smooth, being formed of a single piece. There is also a clear flow of air through the slots (32 & 33) at the corners, without any disturbance unlike in the cores (3) of the existing diffusers (1).

The centre core (30) of the new diffuser (27) is essentially made in a single piece and consists of a outwardly and directed slanting surface (35) originating from a central point and ending into a substantially horizontal flange at the bottom and thus there is no grooved channel (12) on the back side of slanting surface (35) and also corner sections (6) are not required. Further according to this invention there is no vertical sides provided at the top of the slanting surface (35) and thus there is no enclosed collar. For attaching the centre core (30) to the intermediate core(s) (29) and the outer frame (28), two spaced apart vertical strips (36), having a pair of opposing holes or openings (25), for passing there through a pair of rods/pipes (19), are formed integrally at the slanting surface (35). Supporting ribs (37) may also be provided.

In the centre core there is no grooved channel (12) corner sections (6) and vertical collars has also been dispensed with there by saving in material, time and labour. Further there is no gap being in single piece, hence there is no chance of rejection of air at the corners thus giving an equal and proper distribution of air in all the directions which is clearly shown by arrows in the FIG. 15. The method of manufacturing the new diffuser, and/or its various parts, according to the preferred embodiment of this invention, are as follows:

1. The centre core (30) consisting of an outwardly and downwardly directed slanting surface (35) originating from a central point (apex) and ending into horizontal flange manufactured by of suitable dies, in a sheet metal press, having its inner and outer surface smooth. Two spaced-apart vertical strips (36) having a pair of opposing holes or openings (25) are integrally formed on the upper/back side of the slanting surface (35) and supporting ribs (37) may also be provided. The single piece centre core manufactured as above (30) is without any grooved channels and corner sections manufactured as above, may be stored and/or transported separately and may be used for the assembly of new diffuser or for replacement in an existing diffuser.
2. The intermediate core(s) (29) consisting of a vertical collar (31) at the top, an outwardly and downwardly directed slanting surface and a flange at the bottom, is made in a single piece with the help of suitable dies, in a sheet metal press, having its inner and outer surface smooth. The four corners of the vertical collar (31) are cut to form clear slots (32, 33) and the two opposing vertical sides (34) are provided with a pair of opposing holes or openings (25). The single intermediate core(s) (29) without having any grooved channels and corner sections manufactured as above, may be stored and/or transported separately and may be used for the assembly of new diffuser or for replacement in an existing diffuser.

3. The outer frame (28) consisting of a stepped vertical collar, an outwardly and ownwardly directed slanting surface and a flange with its outer free edge bent upwards, is made in a sheet metal press having its inner and outer surface smooth. The two opposing sides of the vertical collar are provided with at least a pair of holes. The single piece outer frame without having any grooved channels and corner sections, manufactured as above, may be stored and/or transported separately and may be used for the assembly of new diffuser or for replacement in existing diffuser.
4. The centre core (30), intermediate core(s) (29) and the outer frame (28) are painted, plated or powder coated in a desired colour.
5. For assembling the new diffuser, the centre core (30) and the intermediate core(s) are assembled first, keeping the slanting surfaces parallel to each other and passing a pair of rods/pipes through the holes or openings (25) provided in the vertical strips (36) and in the vertical sides (34) of the vertical collar (31). The outer frame (28) is now attached by passing the free ends of the rods/pipes through the holes in the vertical collar of the outer frame. One end of the said rods/pipes is kept spring loaded/biased for easy detaching the said cores from the outer frame. It is now clear from the above description with reference to figures that the new diffuser required less number of parts hence the weight of diffuser is less, thus saving of costly material, labour and time which will reduce the cost. As no assembly of pieces of the individual cores is required, there will be no need of crimping equipment and/or welding equipment. As there are no grooved channels, corner sections and enclosed collars, there is no obstruction to the air flow. As now there is no chance of any gap, there will be no rejection of the final product. The new diffuser will remain very clean. As there is no gap at the corners, hence no dust accumulation giving an aesthetic look and at the same time it will be easy to clean any dirt at the inner surface, being smooth. The new diffuser can be made with the help of suitable dies in a sheet metal press and can be powder coated in various colours according to the interior of the room/space and there will not be any dirt on the outer surface giving an ugly look to the nicely painted surface of the new diffuser according to this invention.
6. The new outerframes with increasing flat flanges but keeping the outer size as standard size along with the new core(s) and centre core also provide diffuser with standard outer size and variable passage of air depending upon number of intermediate cores inside, thus giving standard size for the false-ceiling.

An embodiment for improved single piece diffuser as shown in FIG. 16 to 20, wherein the peripheral flange of the single piece outer frame is extended so that it matches with the size of the ceiling, the free edges are bent upwards or bent in a typical arrangement as shown in figure so that it can rest and fix itself on the ceiling directly.

Figure 21A:
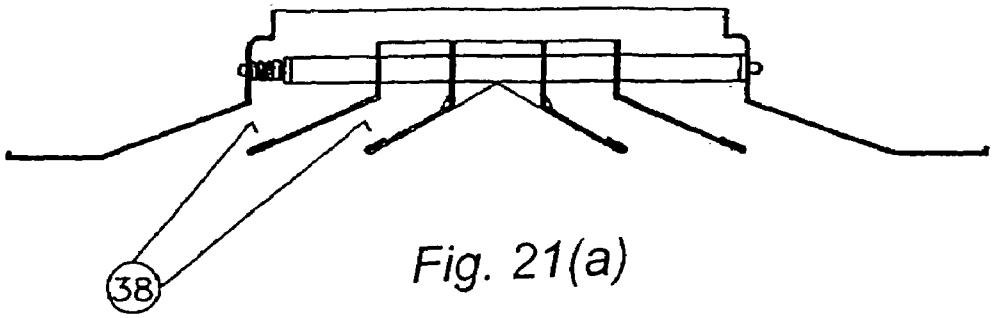
FIGS. 21*a* and 21*b* show an alternate embodiment of the invention.
Figure 21B:
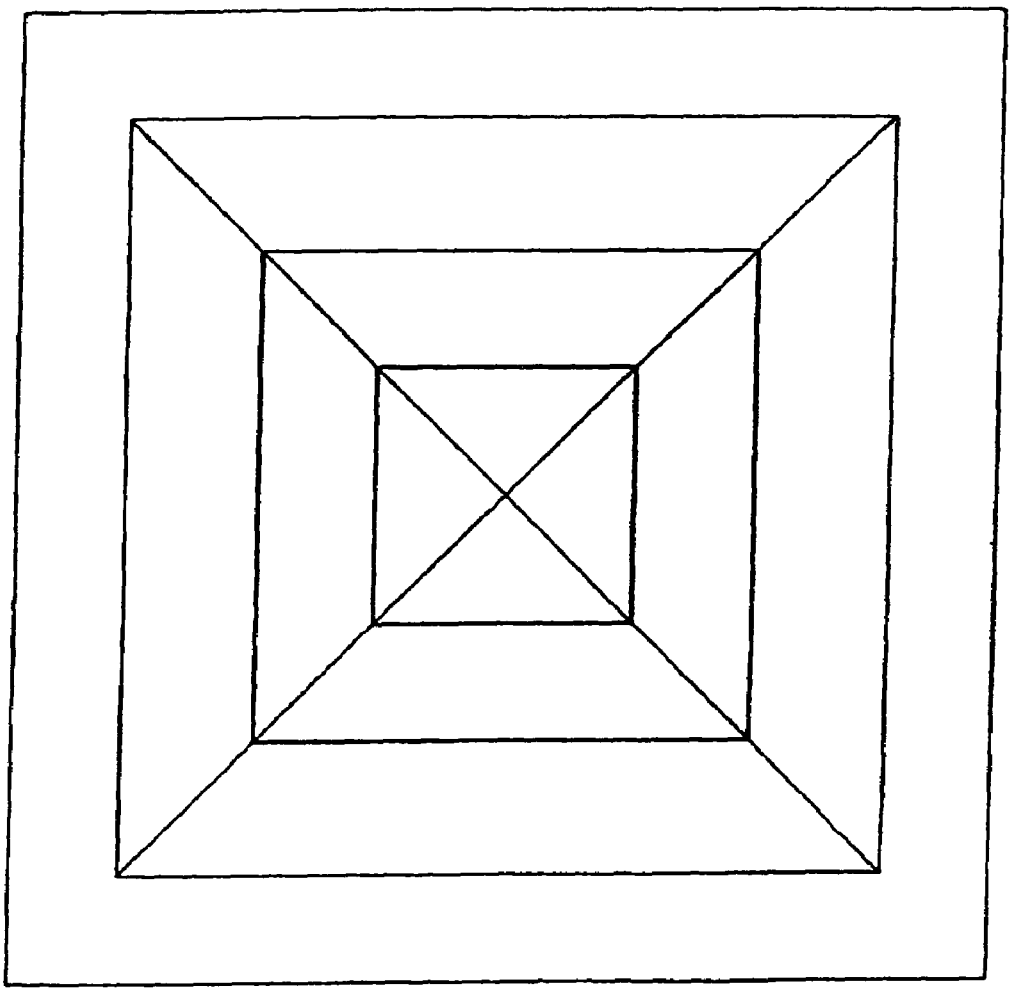

A further embodiment for improved single piece diffuser as shown in FIG. 21 wherein the center core and intermediate core(s) has slanting surfaces without flanges for easy escape of air without obstruction thereby preventing noise, the said core member extending at an acute angle with the perpendicular which provides smooth flow of air without obstruction, the flange being removed by either cutting or bending the flange of the center or intermediate cores backwards (38) to avoid obstruction.

The coated surface prevents any rust accumulation due to the moist atmosphere. The single piece air diffuser having multiplicity of cores arrange overlapping each other with spaced/air gap for easy distribution of air gently flowing without noise.

The above description with reference to drawings is given just to understand the invention rather than to limit its scope, as modifications without departing from the main theme of the invention are possible, which will be evident to a person skilled in the art, should also be considered as falling within the ambit and scope of this invention and the appended claims.

The invention claimed is:

1. Diffuser for a central air conditioning system comprising at least a center core element and at least an intermediate core element;

said center core element comprising a single continuous piece defining an outwardly and downwardly extending slanting wall originating from an upper apex and terminating at a lower peripheral edge area, said wall having smooth inner or lower and outer or upper surfaces;

a plurality of generally vertically extending, laterally spaced strips attached to opposite sides of the upper surface of said wall in opposing relationship;

each of said strips having at least one hole for receiving a mounting fastener, each hole of each strip aligned with an opposed hole of an opposed strip;

said intermediate core element comprising an upper, generally vertically extending collar connected at its lower end to an outwardly and downwardly extending wall terminating at a respective peripheral edge area, said wall of the intermediate core having smooth inner or lower and outer or upper surfaces, and said vertically extending collar and outwardly and downwardly extending wall of said intermediate core element being constructed in one continuous piece;

at least one pair of opposed, aligned holes in said collar;

said center and intermediate core elements configured so that the center and intermediate cores may be assembled in nested relationship with the outer or upper wall surface of the center core located centrally within the inner or lower wall surface of the intermediate core element and with all of said opposed holes aligned with each other;

wherein corner portions are removed from the vertical collar of said intermediate core element to define clear slots whereby a free flow of air circulated through the diffuser around the vertical collar is enabled.

2. Diffuser according to claim 1, including an outer frame element formed in one continuous piece and comprising a generally vertically extending upper collar at its upper area from which extends a downwardly and outwardly extending wall having an inner surface and terminating at a generally horizontally extending peripheral flange area;

said upper collar of said outer frame element having at least one pair of opposed, aligned holes;

said center core element, intermediate core element, and outer frame element configured so that they may be assembled in nested relationship with the outer or upper surface of said wall of said intermediate core element locate centrally within the inner or lower wall surface of said outer frame element and with the outer or upper wall surface of the center core located centrally within the inner or lower wall surface of the intermediate core element and with all of said opposed holes aligned with each other.

3. Diffuser according to claim 2, including at least one generally horizontal rod connector extending through at least one set of aligned opposed holes to thereby secure against separation the inner core, intermediate core and frame in nested relationship.

4. Diffuser according to claim 3, said rod comprising a spring loaded extendible, variable length rod element.

5. Diffuser according to claim 3, wherein said opposed, aligned holes comprise multiple pairs of horizontally spaced apart aligned opposed holes in said strips, intermediate core collar, and upper frame collar elements, and including a generally horizontally extending rod connector element extending through each set of aligned opposed holes to thereby secure against separation the inner core, intermediate core and frame in nested relationship.

6. Diffuser according to claim 1, wherein said opposed, aligned holes comprise multiple pairs of horizontally spaced apart aligned opposed holes in said strip and collar elements.

7. Diffuser according to claim 6, said rod connector elements each comprising a spring loaded, variable length rod.

8. A diffuser for a central air conditioning system, comprising:

at least a center core element and at least an intermediate core element;

said center core element comprising a single continuous piece defining an outwardly and downwardly extending slanting wall originating from an upper apex and terminating at a lower peripheral edge area, said wall having smooth inner or lower and outer or upper surfaces;

said single continuous piece further defining a plurality of generally vertically extending, laterally spaced strips extending from opposite sides of the upper surface of said wall in opposing relationship;

each of said strips having at least one hole for receiving a mounting fastener, each hole of each strip aligned with an opposed hole of an opposed strip;

said intermediate core element comprising an upper, generally vertically extending collar connected at its lower end to an outwardly and downwardly extending wall terminating at a respective peripheral edge area, said wall of the intermediate core having smooth inner or lower and outer or upper surfaces, and said vertically extending collar and outwardly and downwardly extending wall of said intermediate core element being constructed in one continuous piece;

at least one pair of opposed, aligned holes in said collar;

said center and intermediate core elements configured so that the center and intermediate cores may be assembled in nested relationship with the outer or upper wall surface of the center core located centrally within the inner or lower wall surface of the intermediate core element and with all of said opposed holes aligned with each other.

* * * * *